US008971562B2

(12) United States Patent
Clayton et al.

(10) Patent No.: US 8,971,562 B2
(45) Date of Patent: Mar. 3, 2015

(54) WIRELESS HEADPHONE WITH PARIETAL FEATURE

(71) Applicant: WR Nine Ventures LLC, Dallas, TX (US)

(72) Inventors: Mark Clayton, Grand Prairie, TX (US); John Grayson Estes, Oklahoma City, OK (US); Phillip Dale Lott, Nashville, TN (US)

(73) Assignee: WR Nine Ventures LLC, Dallas, TX (US)

( * ) Notice: Subject to any disclaimer, the term of this patent is extended or adjusted under 35 U.S.C. 154(b) by 0 days.

(21) Appl. No.: 13/782,943

(22) Filed: Mar. 1, 2013

(65) Prior Publication Data

US 2013/0243235 A1 Sep. 19, 2013

Related U.S. Application Data

(60) Provisional application No. 61/606,006, filed on Mar. 2, 2012.

(51) Int. Cl.
*H04R 1/10* (2006.01)
*H04R 5/033* (2006.01)

(52) U.S. Cl.
CPC ..... *H04R 1/105* (2013.01); *H04R 1/1008* (2013.01); *H04R 5/0335* (2013.01); *H04R 1/1041* (2013.01); *H04R 2420/07* (2013.01); *H04R 2420/09* (2013.01)
USPC ..... 381/374; 381/370; 381/182; 381/371; 381/378

(58) Field of Classification Search
CPC ..... H04R 5/0335; H04R 1/10; H04R 1/28; H04R 5/033; H04R 1/105; H04R 1/1066; H04R 1/1075; H04R 2201/10; H04R 2201/103; H04R 2201/107; H04R 2201/109
USPC ..... 381/370, 371, 182, 374, 375, 378
See application file for complete search history.

(56) References Cited

U.S. PATENT DOCUMENTS

| | | | | |
|---|---|---|---|---|
| 4,907,266 | A | 3/1990 | Chen | |
| 6,006,115 | A | 12/1999 | Wingate | |
| 6,104,824 | A | 8/2000 | Ito | |
| 6,195,441 | B1 * | 2/2001 | Ito | 381/381 |
| 6,233,345 | B1 | 5/2001 | Urwyler | |
| 6,245,027 | B1 | 6/2001 | Alperin | |
| 6,680,802 | B1 * | 1/2004 | Ichikawa et al. | 359/630 |
| 6,873,862 | B2 | 3/2005 | Reshefsky | |
| 7,146,187 | B2 | 12/2006 | Richards et al. | |
| 7,187,948 | B2 | 3/2007 | Alden | |
| 7,356,362 | B2 | 4/2008 | Chang et al. | |
| D598,469 | S | 8/2009 | Harris, Jr. | |
| 8,208,672 | B2 * | 6/2012 | Nageno et al. | 381/374 |

(Continued)

FOREIGN PATENT DOCUMENTS

WO WO 2012/026386 * 3/2012 ..... H04R 1/10

*Primary Examiner* — Ahmad F Matar
*Assistant Examiner* — Sabrina Diaz
(74) *Attorney, Agent, or Firm* — Hall Estill Attorneys at Law

(57) ABSTRACT

A headphone can have at least one wireless audio reproducing element attached to a headband. The headband may have parietal and temporal features with the temporal feature contacting a user's temporal bone and the parietal feature having a curvilinear extension from the temporal feature that contacts a predetermined portion of a user's parietal bone.

20 Claims, 7 Drawing Sheets

(56) References Cited

U.S. PATENT DOCUMENTS

| | | | | |
|---|---|---|---|---|
| 8,213,662 | B2 * | 7/2012 | Ishida | 381/371 |
| 8,290,194 | B2 | 10/2012 | Kuo | |
| 8,655,004 | B2 * | 2/2014 | Prest et al. | 381/380 |
| 2003/0073460 | A1 * | 4/2003 | van Pelt et al. | 455/556 |
| 2003/0169898 | A1 | 9/2003 | Arasawa | |
| 2007/0053544 | A1 | 3/2007 | Jhao et al. | |
| 2007/0160250 | A1 | 7/2007 | Kuo | |

* cited by examiner

FIG. 1A
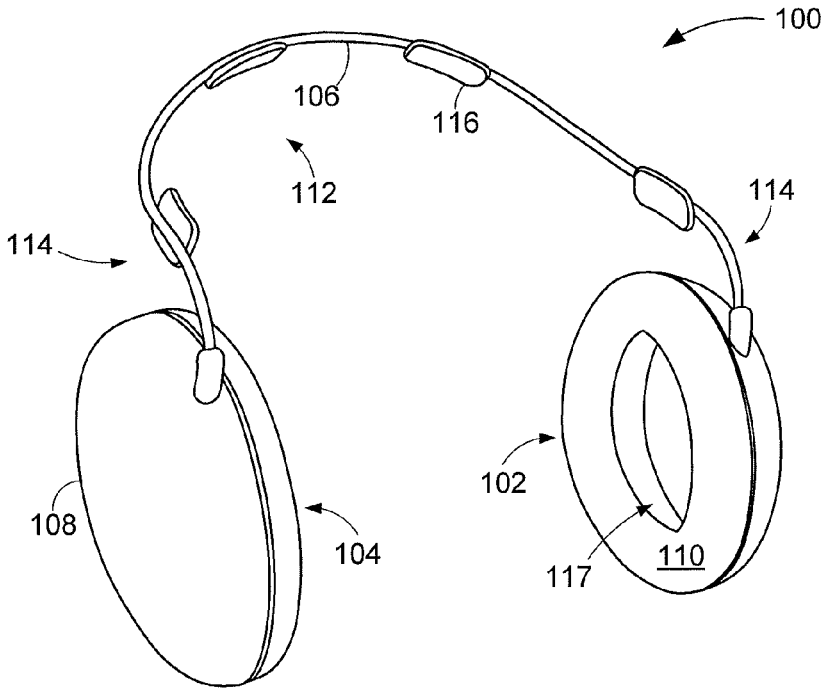
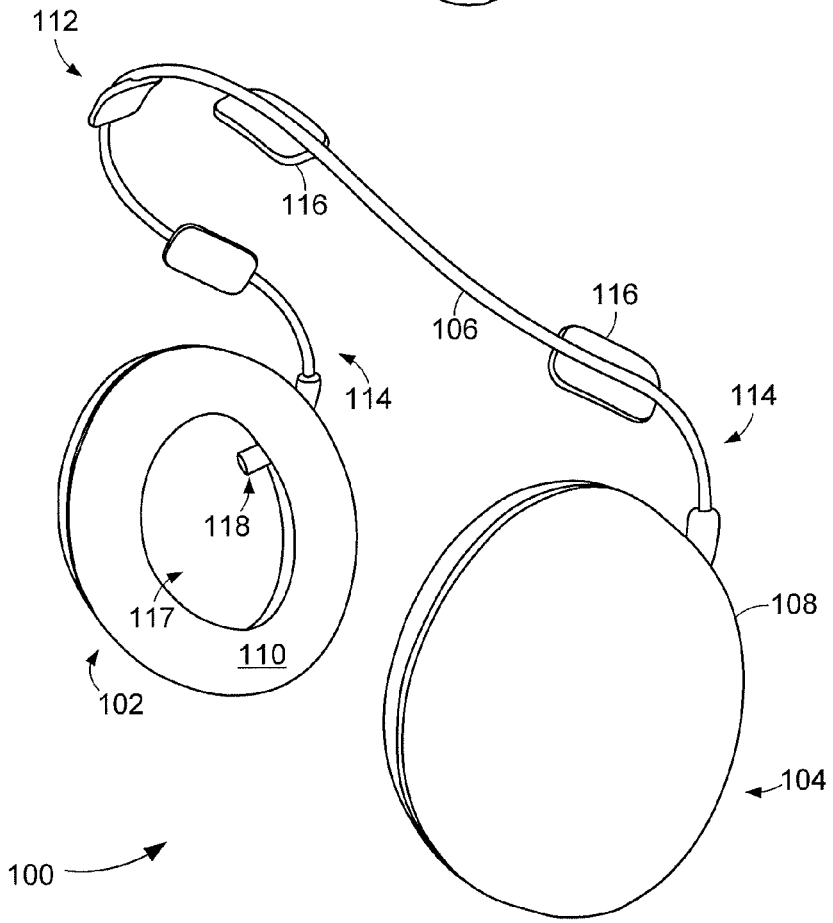
FIG. 1B

WIRELESS HEADPHONE WITH PARIETAL FEATURE

SUMMARY

Various embodiments are generally directed to an audio reproducing headphone that is capable of optimized retention on a user's head.

In accordance with some embodiments, a headphone can have at least one wireless audio reproducing element attached to a headband with the headband having parietal and temporal features. The temporal feature may contact a user's temporal bone and the parietal feature may have a curvilinear extension from the temporal feature that contacts a predetermined portion of a user's parietal bone.

BRIEF DESCRIPTION OF THE DRAWINGS

FIGS. 1A and 1B respectively display front and back perspective view of an example wireless headphone configured in accordance with various embodiments.

DETAILED DESCRIPTION

Figure 2A:
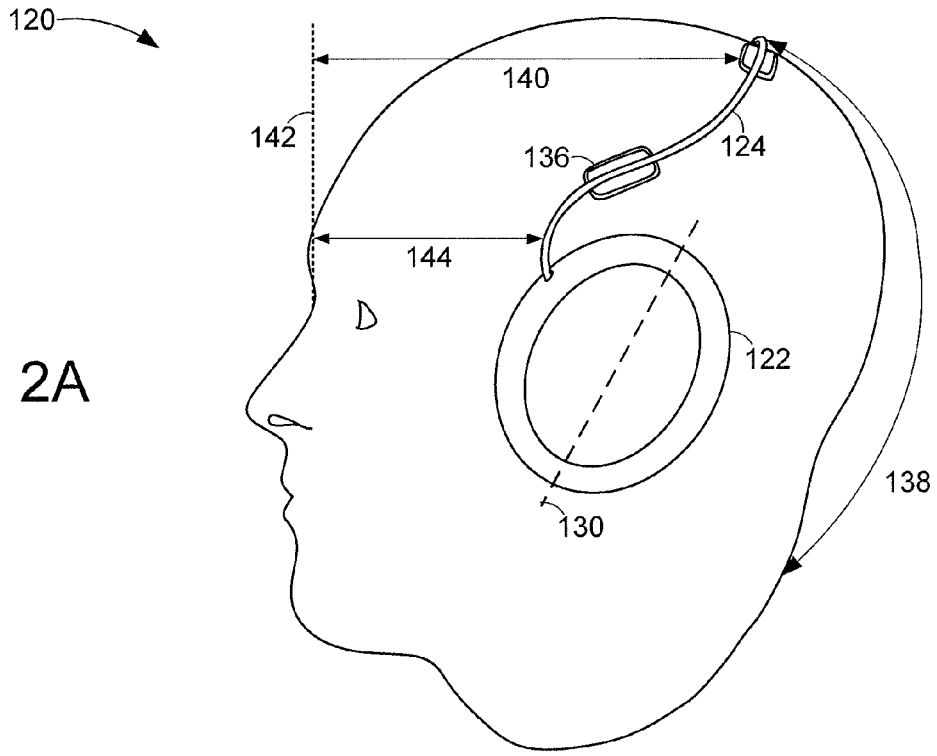
FIGS. 2A and 2B respectively show side perspective views of an example wireless headphone as constructed and operated in accordance with some embodiments.

With the proliferation of electronics that have decreased the form factors, increased processing capabilities, and reduced power consumption, such electronics can be integrated into mobile devices. The integration of audio storage and reproduction, especially with music files such as .MP3 files, into mobile devices has strained the capabilities of some hardware, such as audio headphones. That is, the ability to engage stored audio files from nearly anywhere has strained the capability of audio reproducing hardware to maintain placement during activities associated with mobility.

The dislocation of audio reproducing hardware during user movement can degrade audio quality and reduce the mobility potential of the audio storage device. For instance, a speaker may be jostled and dislocated from close proximity to a user's ear while the user is engaged in continuous or sporadic movement like various stretching, running, and jumping activities corresponding to an athlete warming up prior to a sporting event. Hence, there is a continued demand for audio reproduction hardware that can maintain position on a user's head while undergoing rigorous activities.

Accordingly, a mobile electronics device may be constructed with at least one wireless audio reproducing element attached to a headband that has parietal and temporal features with the temporal feature contacting a user's temporal bone and the parietal feature having a curvilinear extension from the temporal feature that contacts a predetermined portion of a user's parietal bone. Tuning the parietal feature for shape and size can provide at least three concurrent points of contact on strategic areas of a user's head, such as, but not limited to, the temporal bone about a user's ears and the parietal bone of the user's skull.

The simultaneous lateral and vertical contact from the parietal and temporal features can allow for enhanced control of the headphone during movement, which contrasts headband contact with the frontal bone of the skull or extension of the headband around the back of the user's neck. Such optimized headphone control may be attributable at least in part to the shape of parietal bone compared to the frontal bone of the skull and the concurrent lateral and vertical pressure exerted on the skull by the headband compared to the headband simply resting on the user's ears.

Turning to the drawings, FIGS. 1A and 1B respectively display different perspectives of an example headphone 100 capable of receiving wireless signals in accordance with some embodiments. Each headphone 100 has first and second ear cups 102 and 104 that can house one or more audio and computer components, such as processors, memory, controls, amplifiers, and speakers. Each ear cup 102 and 104 is connected by a continuous headband 106 that can be configured in an unlimited number of orientations and shapes that allow concurrent contact with the parietal and temporal bones of a user's skull to provide optimized headphone 100 control with discomfort to the user.

One, or both, ear cups 102 and 104 can be constructed with a housing 108 and skin contact pads 110 that may be configured in a variety of different shapes and sizes to fit around and within some or all of a user's ear. For example, the first ear cup 102 can be designed to substantially surround a user's ear on the user's temporal bone with both the skin contact pad 110 and housing 108, which can reduce and eliminate the penetration of external noise into the ear cup 102 while being worn. In other embodiments, both ear cups 102 and 104 can be designed to be approximately the same size as a user's ear to allow the ear cups 102 and 104 to rest atop and within each ear without wholly surrounding the outside of each ear.

The headband 106 may be configured, as shown, to continually extend between and connect the ear cups 102 and 104 with a parietal feature 112 disposed between temporal features 114. While the tuned construction of the headband 106 and features 112 and 114 are not limited to the design of FIGS. 1A and 1B, some embodiments form the headband 106 of a metal like steel, aluminum, and metal alloys that can retain a predetermined shape and provide spring force onto the user's head when worn. Such spring force may be focused to predetermined locations of the temporal and parietal bones of the user through headband cushions 116 that are formed of a different material than the headband 106, such a rubber.

The size, shape, location, and material of the headband cushions 116 can be tuned to provide comfort for the user while ensuring consistent pressure and position of the headband 106 throughout sporadic and continuous user movement. That is, the headband cushions 116 can be formed to localize the spring force of the headband 106 shape to maintain the position of the headband cushions 116 regardless of a user's movement, like somersaults, inverted flips, lateral acceleration, and bouncing, as well as the user's skull characteristics, such as moisture relating to sweat, hair, hair product, headwear, and head shape.

FIG. 1B generally shows the internal ear cavity of the first ear cup 102. As shown, the skin contact pad 110 defines an ear aperture 117 that can be constructed to accommodate some or all of a user's ear. That is, the aperture 117 can be configured to be aligned with a portion of the ear, such as the ear canal, or to be aligned with the entire ear including the lobe and helix. In some embodiments, the aperture 117 have an extension 118 of the headband 106 and may be partially or completely filled with at least one audio speaker, which can have enhanced musical acoustics due to the skin contact pad 110 preventing external noise from contaminating the speaker's output. Various embodiments further can be configured to passively cancel noise external to the ear cups 102 and 104 by emitting a noise-cancelling signal or encapsulating the user's ear so that no external noise can reasonably be heard.

While two ear cups 102 and 104 are shown in FIGS. 1A and 1B, various embodiments may have less than two ear cups. For example, the second ear cup 104 may be omitted from the headphone 100 and replaced with a retention feature, like an adjustable spring or additional cushion, that holds the headphone 100 in place without covering the ear or reproducing audio signals. Such configuration may be prevalent when a user needs to hear external sounds and engage in conversation not corresponding to the audio signal being reproduced in the first ear cup 102, such as for an air traffic controller, pilot, and sports coach.

The example headphone 100 may further have at least one audio input and transmission means, like a microphone, that can transform the headphone 100 into a 2-way communication device. A microphone can be located in any position either internal or external to the ear cups 102 and 104 and may be retractable to allow selected use without damage to the microphone. The addition of a microphone can allow the headphone 100 to be a cellular and radio transmission device that can act as a stand-alone transmitter and receiver or serve as a secured or unsecured peripheral of an external cellular or radio device. The ability to recognize a user's voice via the microphone can further allow the headphone 100 to connect to an external device, such as through a secured Bluetooth connection, and serve as a controller of the external device through voice recognized commands. As a non-limiting example, the microphone can allow the headphone 100 to be used for voice dictation that translates to textual input via connection to an external computer.

Figure 2B:
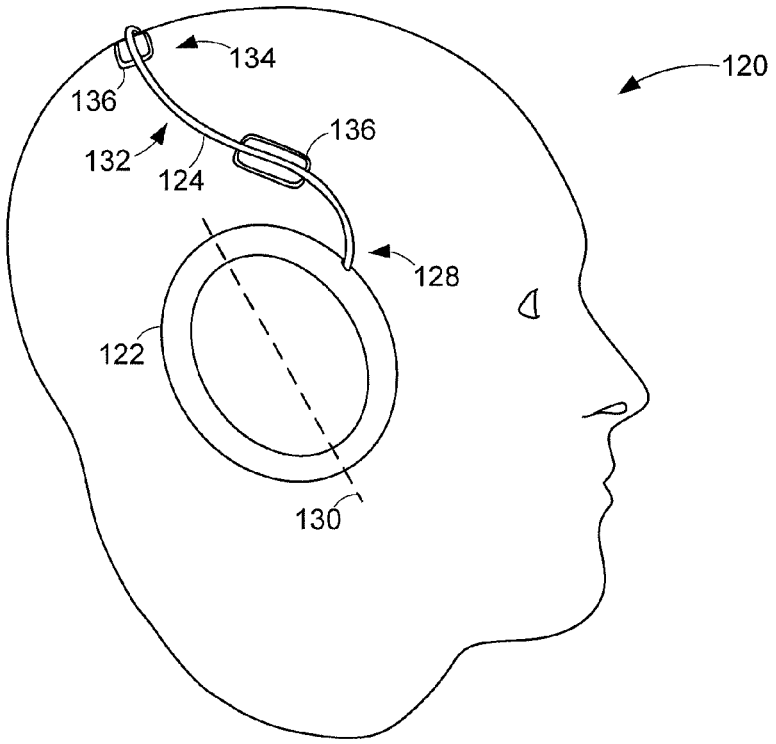

FIGS. 2A and 2B respectively provide perspective side views of an example wireless headphone 120 positioned on a user's head in accordance with various embodiments. The opposite side views of FIGS. 2A and 2B display ear cups 122 connected by a headband 124. Each ear cup 122 is designed to fit substantially on the temporal bone of the user to at least partially encapsulate the user's ear. The headband 124 has a temporal feature 128 that continuously extends from a location offset from the ear cup's 122 longitudinal axis 130 towards the coronal suture of the user's head.

While the temporal feature 128 could continuously extend between ear cups 122 on opposite sides of the user's head, a tuned headband 124 configuration can contact the user's parietal bone 132 with a parietal feature 134 and acts in concert with the temporal features 128 to provide three concurrent points of contact with the user's skull. While continuous contact can be made by each headband feature 128 and 134, positioning tuned headband cushions 136 discontinuously along the headband 124 can focus contact to a predetermined number of skull positions, such as one location on each temporal bone 126 and two separate locations on the parietal bone 132. As such, the number and configuration of the various headband cushions 136 can contribute to maximized headphone comfort and maximum headphone retention during rigorous user movement.

As shown in FIG. 2A, the temporal feature 128 transitions to a parietal feature 134 that arcs to the rear of the user's head to fully contact the parietal bone 132 of the skull, which corresponds to more uniform slope and secure contact between the headband 124 and skull. The parietal feature 134 further allows the longitudinal axis 130 of the ear cup 122 to be aligned along the longitudinal axis of the ear, which is conducive to enhanced listening, while simultaneously contacting the parietal 132 and temporal 126 bones of the skull, which optimizes headphone retention.

FIG. 2A further provides a variety of measurements that show how the headphone 120 fits to a user's head. The position of the parietal feature 134 is to be a predetermined distance 138 from the back of the user's neck, such as a distance that is greater than the distance from the parietal feature 136 to the user's chin. The parietal feature 136 may further be positioned by a predetermined first linear distance 140 from the eye socket of the user, as displayed by segmented plane 142. The first linear distance 140 may be configured to be greater than a second linear distance 144 as measured from the temporal feature 128 to the eye socket plane 142. As shown, the parietal feature 134 can be tuned to contact a portion of the user's parietal bone aligned with the longitudinal axis 130 of the ear cup 122. Such measurements can be modified and tuned to best fit any given user, but can serve as an example of how to engage the parietal feature 134 with the designated portion of the skull to provide maximum stability during movement.

Figure 3A:
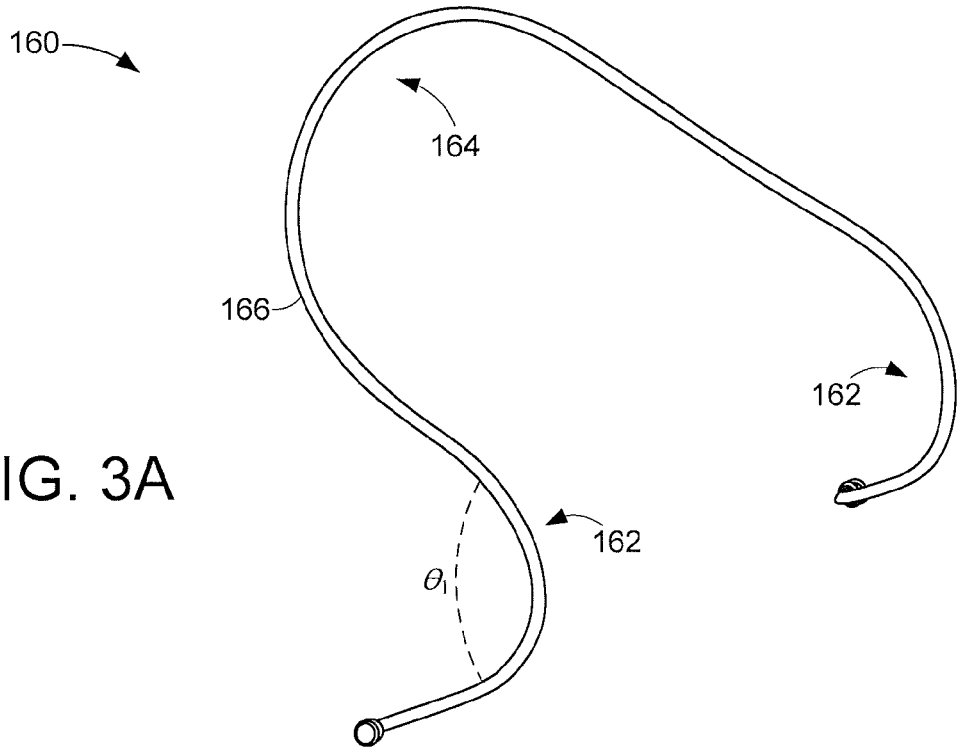
FIGS. 3A and 3B respectively illustrate different perspective views of a portion of an example wireless headphone.
Figure 3B:
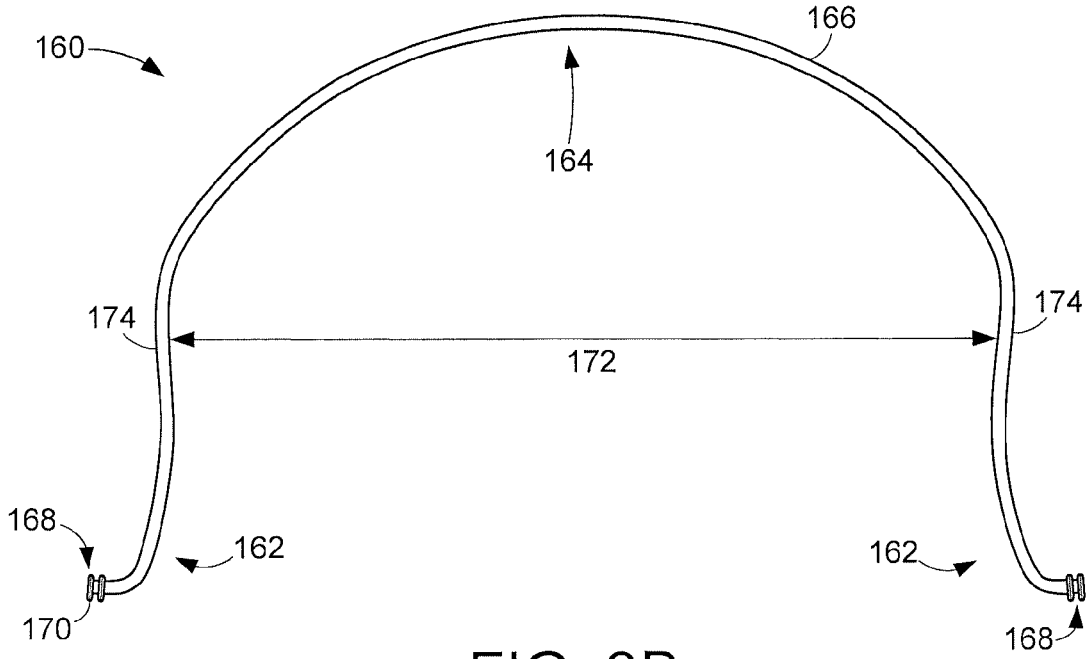

FIGS. 3A and 3B respectively illustrate different perspective views of a headband portion 160 of an example wireless headphone. FIG. 3A shows how the headband portion 160 transitions from the temporal feature 162 to the parietal feature 164 via a continuously curvilinear shape. Although not limited to a particular angular configuration, the temporal 162 and parietal 164 features can be collectively constructed so that the parietal feature 164 is angled with respect to the temporal feature 162 by 90° or more. That is, the headband portion 160 can be tuned to fit a variety of head shapes and sizes through the angled relationship between the features 162 and 164, which in various embodiments is orthogonal or obtuse with respect to each other, as displayed by angle $\square_1$, which can allow a predetermined amount of spring force to be exerted where the headband 166 connects to the ear cups.

The headband portion 160 may further be constructed with coupling features 168 on opposite ends of the headband 166 that allow for a secure connection with ear cups and efficient replacement. Such replacement may correspond with an ability to switch headbands 166 with ear cups to provide different amounts of spring force, headband materials, headband shapes, headband colors, and parietal feature configurations that can cater to a wide variety of head shapes and user preferences.

The coupling features 168 can be individually or collectively shaped and sized in an unlimited variety of configurations, but are tuned to have dual retention rings 170 separated to securely engage a mount. Such mounting and the consequential position of the respective ear cups may be facilitated through the tuned relationship of the coupling 168 and temporal 162 features. For instance, the coupling feature 168 can form a right angle with the temporal feature 162 along an axis perpendicular to the parietal feature 164 to provide lateral spring tension for the ear cups towards a user's skull. The lateral spring tension can further be tuned by manipulating the distance 172 between transition portions 174 of the headband 166 that are disposed between the temporal 162 and parietal 164 features, as shown in FIG. 3B.

Figure 4A:
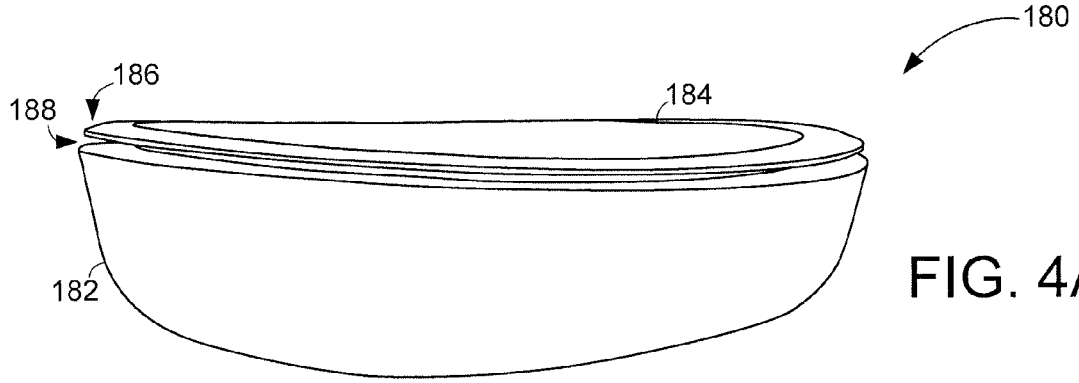
FIGS. 4A and 4B respectively provide side and front views of a portion of an example wireless headphone constructed in accordance with various embodiments.
Figure 4B:
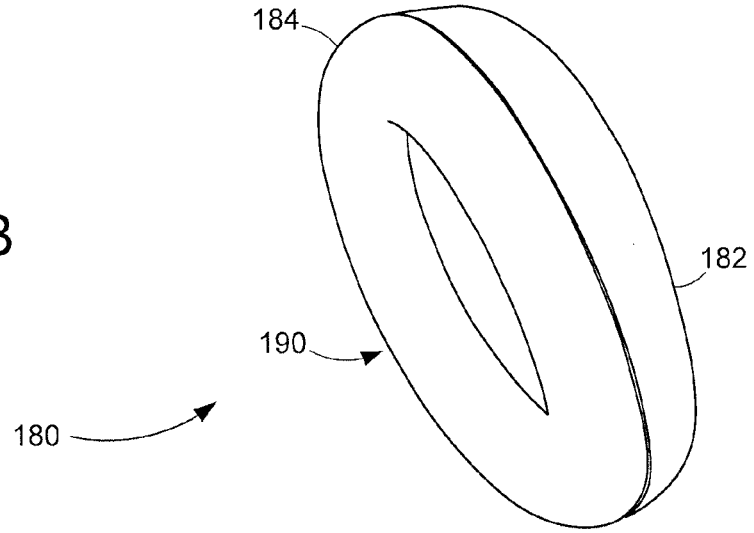

With the variety of features that can be tuned to optimize the comfort, performance, and appearance of the headband 166, precise amounts of spring tension can be exerted along the temporal 162 and parietal 164 features so that the headband 166 maintains an initial position on a user's head regardless of activity and movement. The tuning capabilities of a headphone are not limited to the headband 166; however, as the ear cups may also be customized to provide optimized performance and appearance. FIGS. 4A and 4B respectively display different perspective views of an ear cup 180 capable of being used with the headband 166 of FIGS. 3A and 3B as a headphone.

FIG. 4A provides a view of an ear cup assembly of a rigid outer housing 182 and a flexible skin seal 184. The rigid outer housing 182 can be configured as an unlimited variety of shapes, colors, logos, and materials that provide shock, vibration, moisture, and trauma protection for internal electronics like speakers, control circuitry, and batteries. With knowledge that contact between the rigid outer housing 182 and a user could be uncomfortable, the flexible skin seal 184 can be constructed of rubberized and plastic compounds that can more comfortably contact a user's head while increasing external noise suppression and audio performance. In some embodiments, the skin seal 184 is configured with a tapered, circumferential edge 186 that can reduce sharp edge contact between the user and the rigid outer housing 182 when the ear cup 180 is worn.

The flexible skin seal 184 may further be constructed to provide a flange 188 for possible addition of a soft ear cushion 190, as generally illustrated in FIG. 4B. The soft ear cushion 190 can be formed of antibacterial, antimicrobial material that may or may not wick moisture while providing a soft skin contact surface to optimize a user's interaction with the ear cup 180. The addition of the soft ear cushion 190 may also allow additional graphical considerations for the ear cup and headphone as different materials like leather and colors like fluorescent hues can be utilized to personalize the look of the ear cup. Regardless whether the soft ear cushion 190 is utilized, the ear cup 180 can be configured to provide a plethora of different performance and visual combinations that can enhance a user's audio and social experience.

Figure 5:
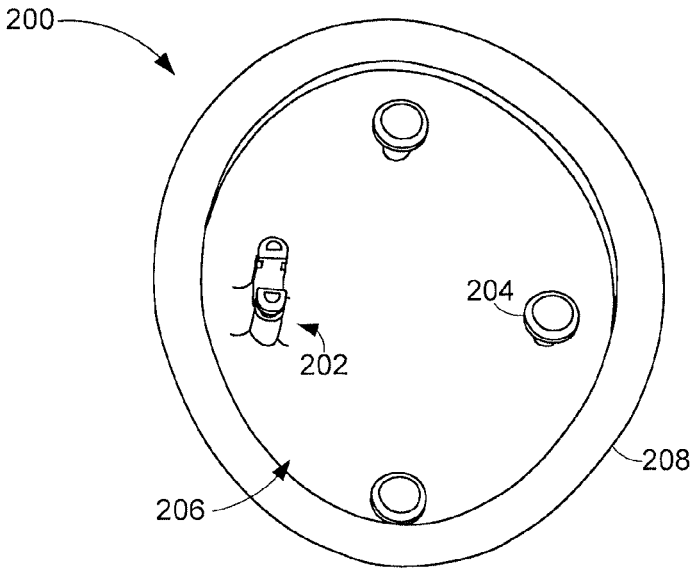
FIG. 5 displays a perspective view of a portion of an example wireless headphone constructed in accordance with various embodiments.

FIG. 5 shows an internal portion 200 of an example ear cup that illustrates how the rigid outer housing 182 of FIGS. 4A and 4B can be tuned to accommodate vastly different head sizes and shapes while providing sophisticated mobile electronics. The internal portion 200 can be constructed, as displayed, with a headband mount 202 which can be configured to secure a coupling feature of a headband through friction, tension, and springs without limitation. The headband mount 202 may be accompanied by one or more articulation mounts 204 that allow electronics, such as a circuit board, to be secured within the cavity 206 defined by the outer housing and skin seal 208. Various embodiments further configure one or more of the articulation mounts 204 to be adjustable to modify the camber and tilt of the ear cup with respect to orthogonal planes, which can customize the comfort and audio performance for a user.

Figure 6:
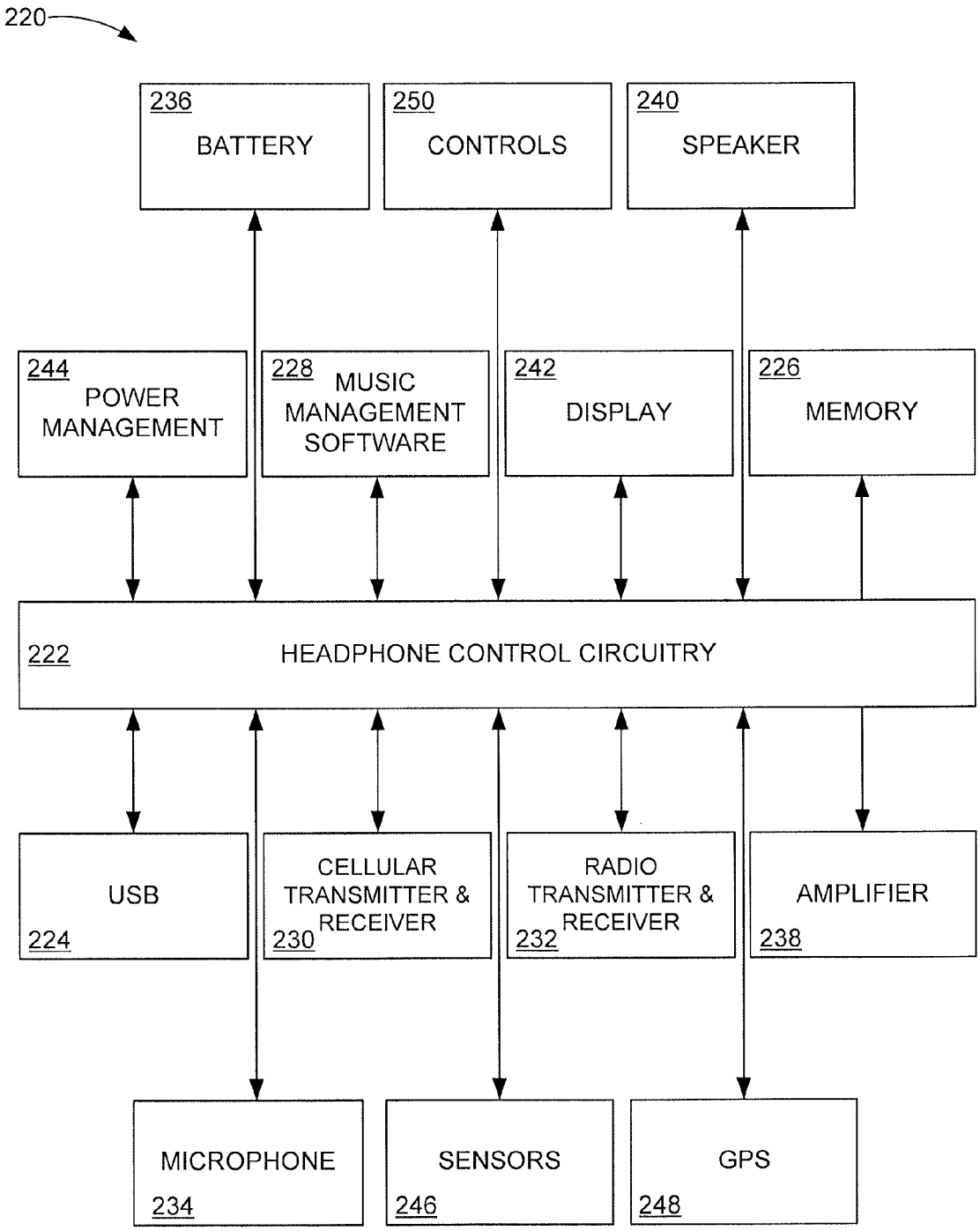
FIG. 6 is a block representation of a portion of an example wireless headphone configured and operated in accordance with some embodiments.

While the variety of structural configurations of FIGS. 1-5 can be tuned to provide comfort and appearance, an example wireless headphone is not limited strictly to tuned physical dimensions as electrical components can be selected, tuned, and optimized to provide a customized headphone capable of diverse operations. FIG. 6 is a block representation of an example wireless headphone 220 configured in accordance with some embodiments to have a local headphone control circuitry 222 that includes at least one computer processor. It should be noted that the headphone control circuitry 222 may be connected to one or more peripheral components, such as a cloud data storage network, accessed via network protocol contained within the control circuitry 222.

In the non-limiting embodiment of FIG. 6, the headphone control circuitry 222 is connected either wirelessly or via a wired electric lead to a number of different components each capable of providing unique and redundant electronic capabilities. As shown, a Universal Serial Bus (USB) 224 can be connected to allow the control circuitry 222 to connect to an external power source and computing device. The USB 224 can be used to upload, download, and update files and software resident in volatile and non-volatile memory 226 resident in the headphone 220. For example, the USB 224 connection may download music management software 228 to the memory 226 that allows audio files to be wirelessly downloaded over cellular 230 and radio 232 transmission means in response to voice commands recognized by a microphone 234.

The music management software 228, regardless of how it was downloaded to the headphone 220, may subsequently play audio files by manipulating power from at least one battery 236 to an amplifier 238 and a speaker 240 to reproduce audio signals recognizable by the user. Such audio reproduction may correspond with the playing of music, engaging in a cellular or radio conversation, and entering verbal commands through the microphone, that may be aided by a display 242 that can be seen external to the headphone 220 and projected to be viewed by a user while the headphone 220 is being worn.

The headphone control circuitry 222 may employ a power management scheme 244 and circuitry that can maximize performance and endurance of the headphone 220 by adjusting the active status of various software and hardware components. For instance, the power management scheme 244 may sense inactivity in the cellular transmitter 230 or that the headphone 220 is not being worn from proximity and temperature sensors 246 to engage in minimizing power delivery to some or all of the control circuitry 222. The addition of various different types of sensors 246 can complement a GPS 248 element to allow the headphone 220 to track and store physical data pertaining to a user, such as distance traveled, calories burned, balance, and geo-positional locations visited, which may be downloaded or utilized by software to provide advertising, user knowledge, and situational statistics.

Figure 7:
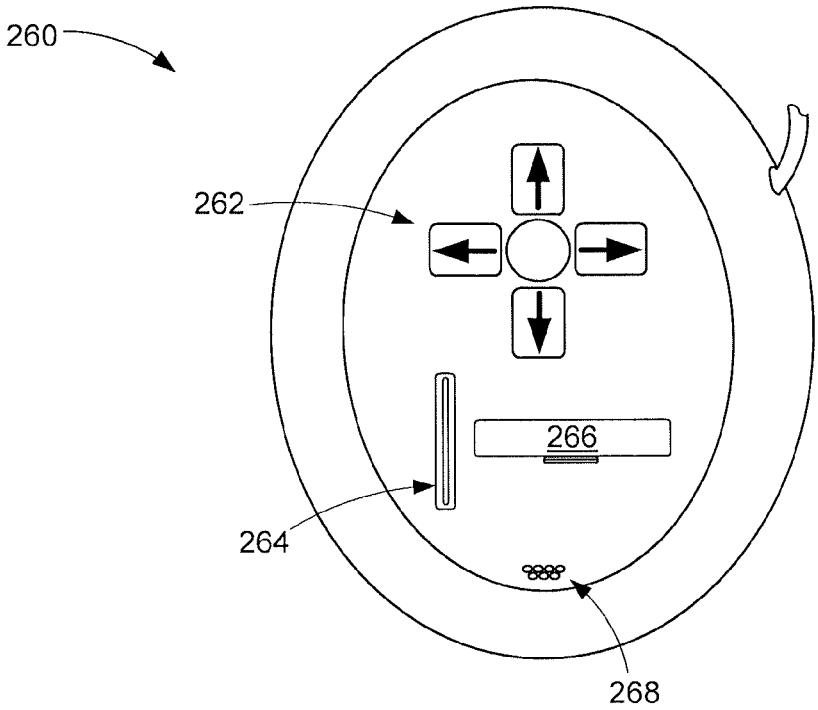
FIG. 7 provides a side profile view of a portion of an example wireless headphone as constructed in accordance with various embodiments.

The control circuitry 222 may further provide wired and wireless controls 250 that can correspond to internal and external software programs. FIG. 7 displays a block representation of an example ear cup 260 having tactile controls 262 that may be used exclusively or concurrently with voice controls received via the microphone 234. The external housing of the ear cup shown in FIG. 7 may also provide a memory port 264 that allows external data storage, such as solid state and rotating memory drives, to be physically connected to the control circuitry of the headphone.

A battery compartment 266 may be accessible via a door, as shown, or sealed as part of the headphone control circuitry and can be rechargeable via wired or wireless charging means. The ear cup 260 can be configured with a microphone 268 that supplements a voice recognition microphone and measures ambient noise so that noise cancellation and audio adjustment can be passively conducted with the control circuitry to optimize a user's audio experience. For example, using a headphone as a cellular or music reproduction device in a loud environment like a restaurant or sports stadium can be passively handled by the production of noise-cancelling tones or the increase in audio volume that is passively conducted by the headphone control circuitry so that the user is not burdened with optimizing audio performance.

Figure 8:
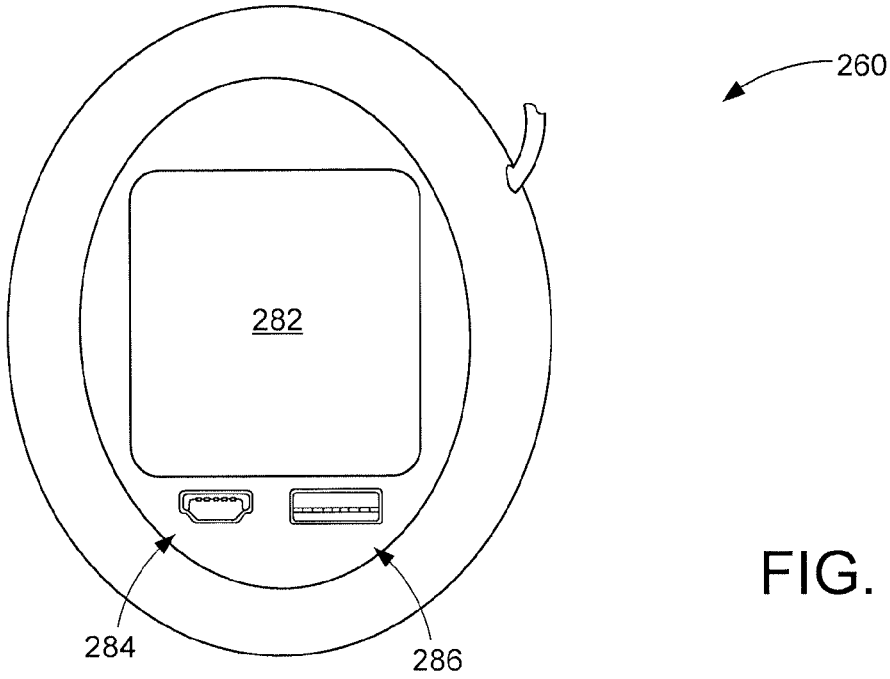
FIG. 8 illustrates a side profile view of a portion of an example wireless headphone as constructed in accordance with some embodiments.

FIG. 8 also provides a block representation of an example ear cup 280 capable of being used exclusively and in conjunction with the ear cup 260 of FIG. 7. The ear cup 280 of FIG. 8 has a display 282 that may be LED, OLED, and LCD without limitation to visually provide feedback to a user regarding any variety of system, software, sensed, and environmental data. As a non-limiting example, the display may be used to show battery life as well as play a video and track ambient air temperature along with the user's body temperature. The ability to utilize the display 282 can increase the functionality of the headphone by providing uses, such as internet browsing and video playback, which can be undertaken without the ear cup 280 contacting the user's head.

The wired connectivity of the ear cup 280 can also be tuned to be as simple or diverse as desired. The inclusion of different types of USB ports 284 and 286 illustrates the unlimited variety of connection possibilities by having both wireless and wired data and power inputs. The ability to connect to external devices via wired and wireless means may allow for tactile and voice control of local and external electronic devices to engage in a multitude of different activities. The diverse connectivity of a headphone configured in accordance with various embodiments can consequently consolidate several separate devices, such as music players, cellular phones, and GPS tracking sensors, into a single device that engages the user's head in a manner that ensures stability and performance regardless of the user's activity.

Figure 9:
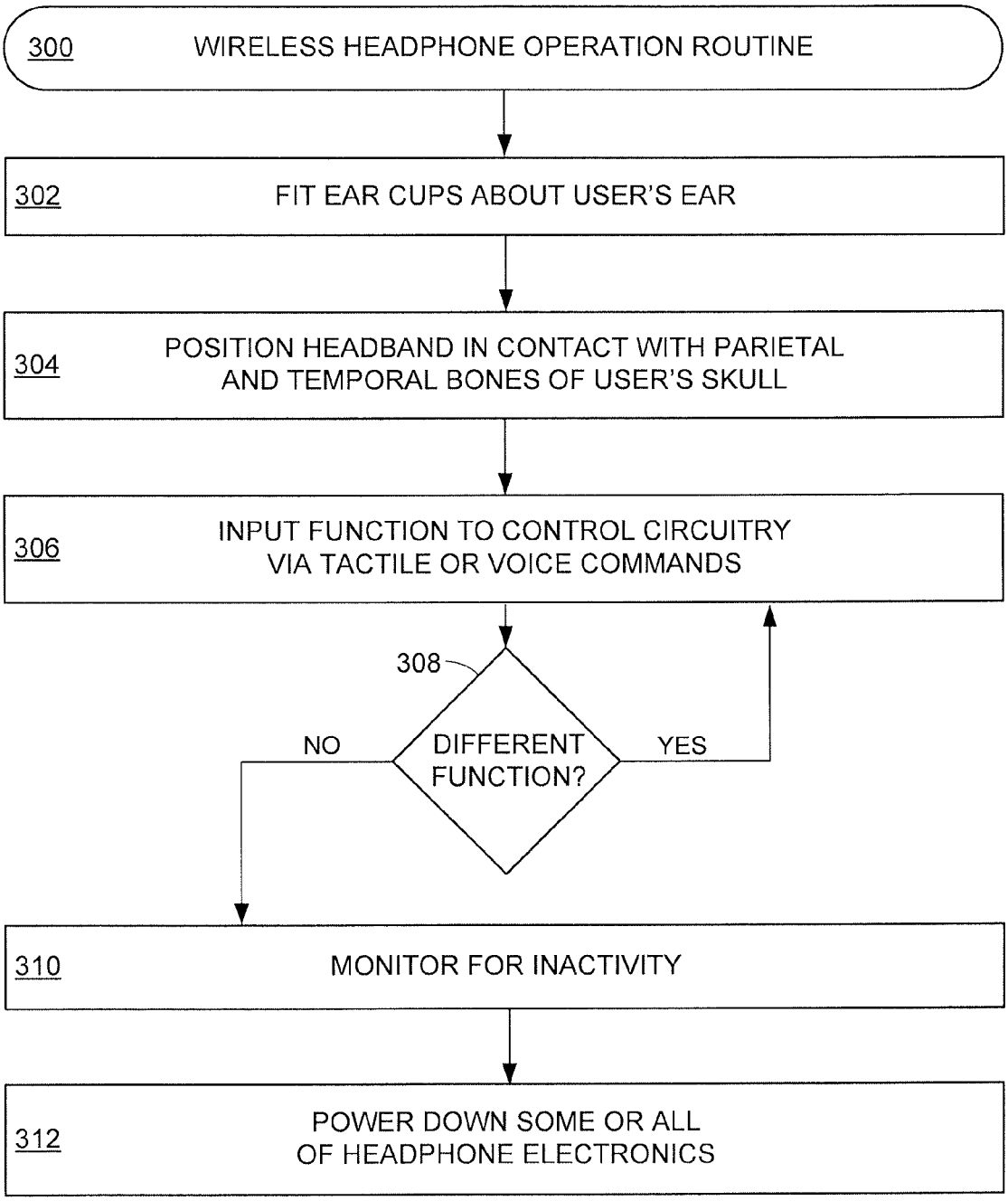
FIG. 9 displays a flowchart of an example wireless headphone operation routine conducted in accordance with various embodiments.

With such diverse operational configurations in mind, FIG. 9 generally displays an example wireless headphone operation routine 300 carried out in accordance with some embodiments. Initially, routine 300 fits ear cups about the user's ear in step 302 and subsequently positions the headband in contact with the temporal and parietal bones of the user's skull in step 304. Such headband contact may be done with a number of cushions that engage predetermined portions of the user's skull.

Next, step 306 provides user input to the control circuitry of the headphone to indicate a function, such as music playback, cellular transmission, dictation, and data access, with tactile or voice commands. Decision 308 evaluates if a different function is to be concurrently conducted or to replace the function of step 306. For example, music playback may be conducted in concert with GPS and sensor data logging or music playback may be replaced by cellular transmission such as voicemail access. While decision 308 may be active for an extended period of time and returned to many subsequent times, step 310 may also be active in monitoring headphone circuitry for inactivity.

A detection of system or sub-system inactivity in step 310 can advance routine 300 to step 312 where a controller powers down the inactive portions of the headphone, which may be the entire headphone depending on the type and duration of inactivity. Step 312 may, in some embodiments, temporarily power down some or all of the headphone n a "sleep" mode while operational data is maintained in a local cache to allow immediate response without the loading of boot data.

Through the various steps of routine 300, a user can securely fit the headphone to the temporal and parietal bones that allows nearly limitless range of movement without the ear cups or headband dislocating from their initially engage skull locations. It should be noted that the routine 300 is not limited to the steps and decision shown in FIG. 9 as the various aspects can be rearranged, edited, and omitted, without limitation. Also, steps and decisions can be added to the routine 300, as desired. For example, a step of orienting each headband cushion so that the largest surface area possible contacts the user's skull may be conducted prior to step 304.

The various aspects and embodiments of this disclose allow functionality to an active person in a wireless over-the-ear headphone that provides self-sufficient audio player function. Audio function can be in the form of a media player capable of reproducing locally or remotely stored audio files such as MPEG-3 ("MP3") files. In addition, the headphone can be utilized as a telephone that includes a microphone to which outgoing and incoming calls can be fielded. Similarly, music (mp3), voicemail messages received on the user's telephone could be uploaded into the headphone for later off-line playback via the local solid-state and rotating data storage.

The same connection that is used to charge the headphone also could be used to load the media player, or to download any recording made using the recording function. Thus, a USB connection can provide power charging and wired connection to an external computer. Such a USB connection could be used for uploading and downloading content files which, in addition to could be any other type of audio file—i.e., podcast, music, etc. Alternatively, a connection may be provided for a cable that could connect to any suitable port, including, but not limited to, a USB port, on a computer for uploading and downloading content.

The headphone may utilize a wireless connection for uploading and downloading content. In addition, the audio reproduction capabilities provided by internal processing, amplification, and speaker means allows audio playback totally within the headphone, without any active connection-wired or wireless to a remote host device. This eliminates dependency on the host device for playback data and reduces power consumption of both the headphone and the host device, which is important if the host device is itself a portable device such as a telephone which may prohibit an athletic person from performing tasks.

Wireless headphones may have a small form factor. Accordingly, not much room is available for a user interface for the media player portion of the integrated headphone. As such, a minimal user interface may be provided but not limited to, allowing the user to select controls to change volume or start and stop playback of stored content, as well as control of the Bluetooth pairing and integrative features with other wireless devices. For example, small "start," "stop," and "record" buttons may be provided. Corresponding visual indicators, such as light-emitting diodes, might also be provided as an indication of the current operating mode. The playback mode may be a fixed sequential mode, or another mode such as a random playback mode, or successive presses of the "start" button may cycle through different playback modes.

The inclusion of multiple microphones in the headphone may be configured to respond to voice commands, which could allow more complex commands, including commands to play particular content. In addition, the microphone could be used to detect the ambient noise level, and to adjust playback volume accordingly or reduce volume of speakers. Hence, a wireless headphone may be constructed with at least a speaker and a wireless receiver that receives wireless audio signals from an external device for playback through the speaker via a digital analog converter (DAC), memory for storing media files, and media circuitry including playback circuitry for playing back those media files through the speaker A person of ordinary skill would recognize from the present disclosure that a headphone with a parietal feature allows for enhanced stability during movement due in part to the creation of multiple points of contact with the user's skull, temporal and parietal, that are conducive to rigorous activity. In contrast, a headphone without a parietal feature may be prone to becoming dislodged from a user during activity.

It is to be understood that even though numerous characteristics and configurations of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. For example, the particular elements may vary depending on the particular application without departing from the spirit and scope of the present technology.

What is claimed is:

1. An apparatus comprising at least one wireless audio reproducing element housed in an ear cup shaped to surround a user's ear and have a longitudinal axis, the ear cup attached to a headband having parietal and temporal features extending from a position on the ear cup offset from the longitudinal axis, the temporal feature contacting the user's temporal bone and the parietal feature comprising a curvilinear extension from the temporal feature that contacts a predetermined portion of the user's parietal bone aligned with the longitudinal axis of the ear cup, the temporal feature positioned a smaller distance from the user's eye socket than the parietal feature.

2. The apparatus of claim 1, wherein the headband is constructed of a continuous metal wire.

3. The apparatus of claim 1, wherein the parietal and temporal features respectively contact the temporal and parietal bones via a plurality of separated cushions.

4. The apparatus of claim 3, wherein the temporal feature has a single cushion and the parietal feature has two cushions.

5. The apparatus of claim 1, wherein the parietal feature is disposed between first and second temporal features positioned on opposite sides of the user's head.

6. The apparatus of claim 1, wherein the wireless audio reproducing element is connected to control circuitry comprising a cellular transmitter and receiver.

7. The apparatus of claim 1, wherein the wireless audio reproducing element is connected to control circuitry comprising local non-volatile memory.

8. The apparatus of claim 1, wherein the parietal feature forms an obtuse angle with the temporal feature.

9. The apparatus of claim 1, wherein the parietal feature forms a right angle with the temporal feature.

10. The apparatus of claim 1, wherein the parietal and temporal features are each continuously curvilinear, respectively.

11. A mobile device comprising first and second wireless audio reproducing elements each housed in an ear cup shaped as an ellipse to surround a user's ear and have a first longitudinal axis, the respective ear cups attached to opposite ends of a headband, the headband having parietal and temporal features extending from a position on the ear cup offset from the first longitudinal axis, the temporal feature contacting the user's temporal bone and the parietal feature comprising a curvilinear extension from the temporal feature that contacts a predetermined portion of the user's parietal bone aligned with the first longitudinal axis, the temporal feature positioned a smaller distance from the user's eye socket than the parietal feature.

12. The mobile device of claim 11, wherein each wireless audio reproducing element is separated from the user's ear by an ear cushion.

13. The mobile device of claim 12, wherein the headband has first and second coupling features selectively engaging a mount in the respective ear cups.

14. The mobile device of claim 13, wherein coupling features each form a right angle to the temporal feature.

15. The mobile device of claim 11, wherein the headband extends from each ear cup with a curvilinear shape towards the first longitudinal axis.

16. The mobile device of claim 15, wherein the first longitudinal axis of each ear cup is aligned with a second longitudinal axis of the user's ear.

17. A method comprising:

providing at least one wireless audio reproducing element housed in an ear cup shaped to surround a user's ear and have a longitudinal axis, the ear cup attached to a headband having parietal and temporal features extending from a position on the ear cup offset from the longitudinal axis; and contacting the user's temporal bone with the temporal feature and the user's parietal bone with the parietal feature, the parietal feature comprising a curvilinear extension from the temporal feature that maintains a position on a predetermined portion of the user's parietal bone during movement, the predetermined portion aligned with the longitudinal axis of the ear cup, the temporal feature positioned a smaller distance from the user's eye socket than the parietal feature.

18. The method of claim 17, wherein the parietal feature is maintained in the predetermined portion of the user's parietal bone during user inversion.

19. The method of claim 17, wherein contact of the parietal feature with the predetermined portion of the user's parietal bone remains constant during the movement.

20. The method of claim 17, further comprising monitoring a first user condition with a first sensor and monitoring a geo-positional location with a second sensor.

* * * * *